US009635454B2

(12) United States Patent
Larrieu

(10) Patent No.: US 9,635,454 B2
(45) Date of Patent: Apr. 25, 2017

(54) BASS-REFLEX SPEAKER CABINET HAVING A RECESSED PORT

(71) Applicant: NEXO, Plailly (FR)

(72) Inventor: Matthias Larrieu, Ledeuix (FR)

(73) Assignee: NEXO, Plailly (FR)

( * ) Notice: Subject to any disclaimer, the term of this patent is extended or adjusted under 35 U.S.C. 154(b) by 0 days.

(21) Appl. No.: 14/419,484

(22) PCT Filed: Aug. 6, 2013

(86) PCT No.: PCT/FR2013/051895

§ 371 (c)(1),
(2) Date: Feb. 4, 2015

(87) PCT Pub. No.: WO2014/023912

PCT Pub. Date: Feb. 13, 2014

(65) Prior Publication Data

US 2015/0222984 A1 Aug. 6, 2015

(30) Foreign Application Priority Data

Aug. 7, 2012 (FR) ..... 12 57662

(51) Int. Cl.
*H04R 1/28* (2006.01)
*H04R 1/20* (2006.01)
*H04R 1/32* (2006.01)

(52) U.S. Cl.
CPC ..... *H04R 1/2826* (2013.01); *H04R 1/323* (2013.01)

(58) Field of Classification Search
CPC .. H04R 1/2815; H04R 1/2823; H04R 1/2826; H04R 1/2846; H04R 1/2849
USPC ..... 181/156, 148, 199, 152; 381/345, 349
See application file for complete search history.

(56) References Cited

U.S. PATENT DOCUMENTS 2,816,619 A 12/1951 Karlson
2,787,332 A * 4/1957 Fulmer ..... H04R 1/2857 181/156
2,852,087 A * 9/1958 Ruschhaupt ..... H04R 1/2826 181/151
2,971,598 A * 2/1961 Sieler ..... H04R 1/2865 181/152
3,729,061 A * 4/1973 Tamura ..... H04R 1/2826 181/146
4,126,204 A 11/1978 Ogi et al.
4,196,790 A 4/1980 Reams
4,231,445 A * 11/1980 Johnson ..... H04R 1/345 181/148
4,313,521 A 2/1982 Rodden
(Continued)

FOREIGN PATENT DOCUMENTS

EP 0612194 A1 8/1994
FR 2534437 A1 4/1984

OTHER PUBLICATIONS

International Search Report, dated Nov. 6, 2013, from corresponding PCT application.

*Primary Examiner* — Edgardo San Martin
(74) *Attorney, Agent, or Firm* — Young & Thompson

(57) ABSTRACT

The speaker cabinet (1) includes at least one loudspeaker (2) and at least one port (3), the port having an outlet (32) formed in a wall of the cabinet (1), an inlet (31) inside the cabinet (1), and a casing connecting the inlet (32) and the outlet (31) together, the inlet (32) of the port (3) further having at least one recess in the casing.

27 Claims, 6 Drawing Sheets

(56) References Cited

U.S. PATENT DOCUMENTS

| | | | | | |
|---|---|---|---|---|---|
| 5,012,889 | A * | 5/1991 | Rodgers | H04R 1/2819 | 181/144 |
| 5,012,890 | A * | 5/1991 | Nagi | H04R 3/002 | 181/153 |
| 5,109,422 | A * | 4/1992 | Furukawa | H04R 1/023 | 181/160 |
| 5,111,905 | A * | 5/1992 | Rodgers | H04R 1/2819 | 181/152 |
| 5,150,417 | A * | 9/1992 | Stahl | H04R 1/2826 | 181/144 |
| 5,513,270 | A * | 4/1996 | Lewis | H04R 1/2826 | 181/160 |
| 5,552,569 | A * | 9/1996 | Sapkowski | H04R 1/2865 | 181/151 |
| 5,576,522 | A * | 11/1996 | Taso | H04R 1/2819 | 181/156 |
| 6,275,597 | B1 * | 8/2001 | Roozen | H04R 1/2826 | 181/156 |
| 6,339,649 | B1 | 1/2002 | Chen et al. | | |
| 6,597,795 | B1 * | 7/2003 | Swenson | H04R 1/2826 | 181/156 |
| 6,912,290 | B1 * | 6/2005 | Thorsell | H04R 1/2826 | 181/185 |
| 8,351,630 | B2 * | 1/2013 | Ickler | H04R 1/345 | 381/337 |
| 8,391,510 | B2 * | 3/2013 | Vincenot | 381/349 | |
| 8,391,528 | B2 * | 3/2013 | Vercelli | H04R 1/2826 | 181/156 |
| 2012/0247866 | A1 * | 10/2012 | Lage | H04R 1/2826 | 181/196 |

* cited by examiner

Fig.8
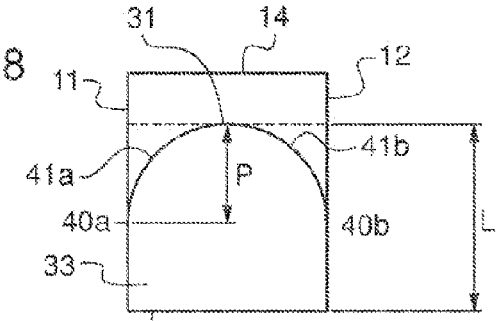
Fig.7
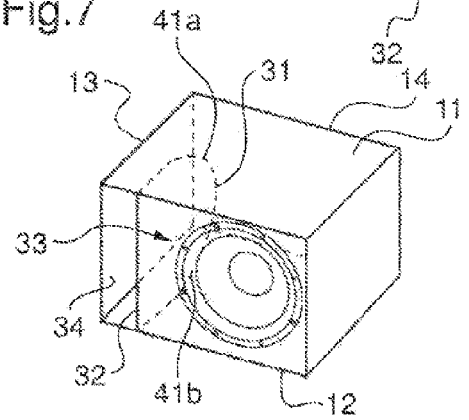
Fig.9
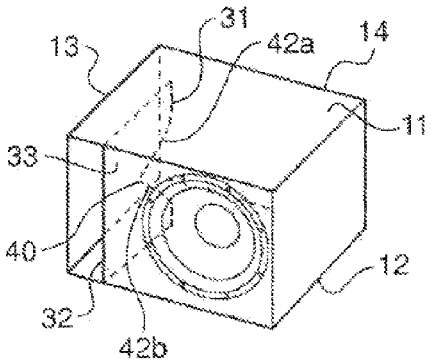
Fig.10
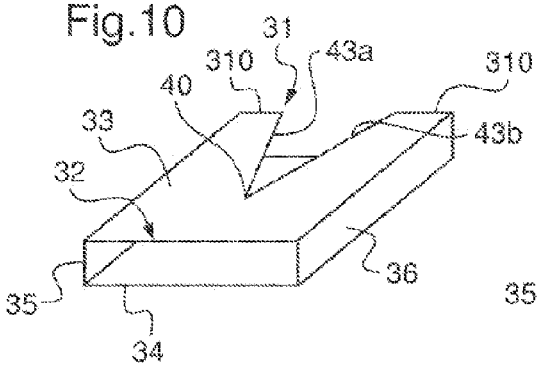
Fig.11
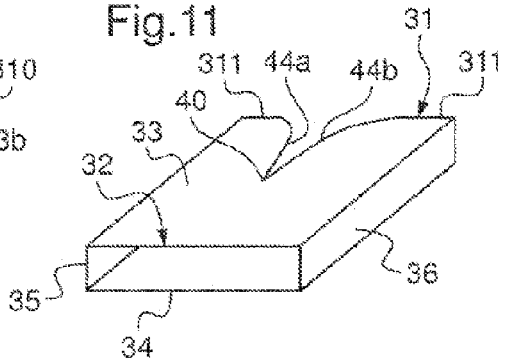
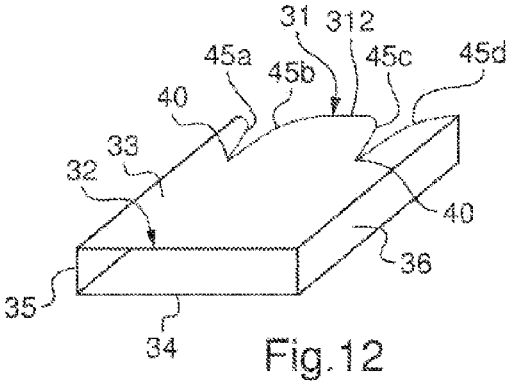
Fig.12
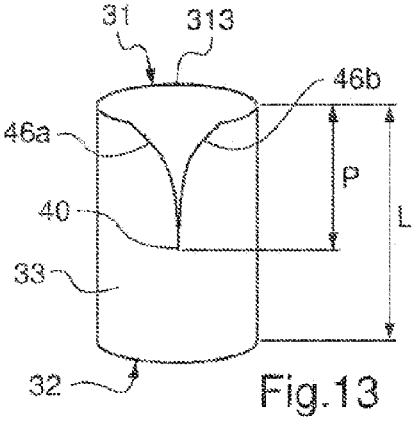
Fig.13

BASS-REFLEX SPEAKER CABINET HAVING A RECESSED PORT

The present invention relates to a speaker cabinet, and more particularly a cabinet with a port, also called a "bass-reflex" cabinet.

Such a cabinet conventionally comprises, apart from a loudspeaker, a port for increasing the efficiency of the lowest-frequency radiation (typically between 20 Hz (hertz) and 200 Hz) compared with a closed cabinet, i.e. one without a port.

Certain cabinets can comprise several loudspeakers, and/or several ports for increasing low-frequency power.

A cabinet of the bass-reflex type therefore has two types of radiating surfaces, namely on the one hand a port (or several ports) radiating around a tuning frequency $f_c$ (EV curve), and on the other hand a loudspeaker (or several loudspeakers) the radiation of which exceeds that of the port (or ports) above a contribution limit frequency $f_L$ (HP curve), as shown in FIG. 5. These two frequencies $f_c$ and $f_L$ are determined by the dimensions of the port and of the cabinet. Above the tuning frequency $f_c$, the loudspeaker and the port radiate in phase which increases the efficiency of the radiation, whereas below, the loudspeaker and the port radiate in phase opposition, which is shown in FIG. 5 by the fact that an S curve representing the sum of the contributions of the loudspeaker and of the port passes above the curves EV and HP starting from the frequency $f_c$.

A port is generally composed of a casing, formed by one or more partitions, having an inlet and an outlet and defining an internal volume of the port. The inlet is situated in the cabinet and the outlet is constituted by an opening formed in one wall of the cabinet, i.e. a hole or a cut-out in one wall of the cabinet. The outlet often has a circular or rectangular shape, and the casing is conventionally cylindrical, meaning that the port has a constant cross-section along an axis connecting the inlet and the outlet, irrespective of the shape of this cross-section.

According to certain cabinet architectures, the casing of the port can in particular be at least partially constituted by at least a part of one wall of the cabinet.

Dimensioning a cabinet involves solving a system of equations in order to determine the vibration velocities of the port and of the loudspeaker as a function of the frequency of sound to be emitted, as well as the two resonance frequencies ($f_1$ and $f_2$) of the system and the tuning frequency ($f_c$) situated between these two resonance frequencies. These two resonance frequencies $f_1$ and $f_2$ are characteristic of a system with two degrees of freedom, where the two unknowns for the bass-reflex cabinet are the velocity of the port and the velocity of the loudspeaker.

This system of equations is described in detail in the specialist literature, for example in the reference work by Jacques Jouhaneau, Notion élémentaires d'acoustique—Electroacoustique—(Editions Technique et Documentation 2000, section 5, 52).

Now, in order to solve this system of equations, a low-frequency approximation is commonly used in order to determine the tuning frequency $f_c$ of the bass-reflex cabinet, i.e. the frequency where the vibration velocity of the port is maximum.

Solving this system of equations with this approximation leads to the determination of the two resonance frequencies ($f_1$ and $f_2$). On the other hand, the approximation causes the higher-order resonance frequencies situated above $f_1$ and $f_2$ ($f_{r1}$ to $f_{r4}$ can be seen in graphs 4 and 5) to disappear. A curve representing the electrical impedance (in Ohm (Ω) as a function of the frequency then has only two peaks (corresponding to $f_1$et $f_2$) defining between them a minimum corresponding to the impedance at the tuning frequency $f_c$.

Solving this system of equations without approximation thus causes the resonance frequencies $f_r$ ($f_{r1}$ to $f_{r4}$) of higher values than the resonance frequencies $f_1$ and $f_2$ to appear. The corresponding impedance curve, measured at the loudspeaker terminals illustrates in particular the presence of these resonance frequencies $f_r$ by the presence of other peaks, as shown in FIG. 4.

Furthermore, the dimensioning of the cabinet requires the phase shift between the radiations of the loudspeaker and of the port, leading to a significant alteration of the directivity function in a plane comprising the port and the loudspeaker, to be taken into consideration. The use of in-phase sources causes a narrowing of the angular coverage but an increase in the efficiency of the radiation in this coverage range, whereas the use of out-of-phase sources involves a widening of the angular coverage but a degradation in the efficiency of the radiation. This phenomenon is all the more marked at the resonance frequencies $f_r$.

Now, this defect in the behaviour of the bass-reflex cabinet cannot be corrected by processing the signal since the latter would act in the same proportions on the loudspeaker and the port.

The present invention then aims to limit or even prevent the peaks in the response of the port linked to the resonance frequencies $f_r$ so that the frequency response of the assembly, i.e. of the cabinet, is as flat as possible, and the radiation as a function of the orientation relative to the cabinet is, so far as possible, independent of the frequency.

To this end, according to a first aspect of the invention, a speaker cabinet is proposed, comprising at least one loudspeaker and at least one port, the port having an outlet formed in one wall of the cabinet, preferably a front face, an inlet inside the cabinet, and a casing linking the inlet and the outlet, in which the inlet of the port has at least one recess in the casing, for example formed by at least one edge of the casing.

The outlet of the port can have any kind of shape, preferably a circular or rectangular shape, or even square.

The casing is advantageously formed by at least one partition, and defines an internal volume of the port.

In order to produce a larger cabinet, the internal volume of the port advantageously comprises at least one wall, dividing the internal volume into sub-volumes, making it possible to confer greater rigidity on the casing of the port.

By recess here is meant a cut-out, an opening, formed in the casing, situated in the cabinet, starting from the inlet of the port, which forms its starting point, and extending towards the outlet, which defies its end.

A recess is formed by at least one edge of the casing in contact with any other element, i.e. removed from this other element by a distance, measured at its starting point, which is non zero. Here this distance to the starting point is called the "initial width" of the recess.

The recess is preferably formed on the one hand by the edge of the casing, and on the other hand with another element which is, for example, either another edge formed in the casing or, for example, one wall of the cabinet.

Thus it is here considered that a recess has two edges, each edge extending between the end of the recess to the inlet of the port, irrespective of the shape of the end.

In the case where the casing, or at least a part of the casing comprising the recess, is curved, the initial width of the recess is determined by following the shape of the casing between at least the starting point of the edge and the other element. This means, for example, in a case where the initial width of the recess represents half of a circumference of a tubular port, the recess then comprises two edges each with a starting point at one end of the port, the initial width is equivalent to the length of the arc of a circle according to a part of the fictitious casing, i.e. a part of an edge defining the inlet which was present before being cut out in order to form the recess, and not a diameter or a chord length which would join the two starting points of the recess. The width is therefore the distance between the starting point and the other element, or the two starting points, if appropriate, in the plane of the casing.

Preferably, the recess is formed on a flat partition of the casing.

The port is thus for example formed so that the flat partition cooperates with walls of the cabinet so as to form the whole of the casing which simplifies the production of such a port.

Preferably, the recess has a depth p, and a width defined by the distance between its two edges in a direction orthogonal to its depth p, variable according to the depth p, i.e., a width which varies between its starting point and its end.

Here "depth p" refers to a dimension of the recess between its starting point and its end, orthogonal to its width, measured along a length L of the port, i.e. the length of its casing, the length L of the port being here defined by the maximum distance between its inlet and its outlet.

And preferably, the width is maximum at the inlet of the port defining an initial width of the recess, so that its width at the end is much smaller than the initial width, or even zero, meaning that the end of the recess thus forms a point. It is then preferable that the edge of the recess defines at its end an angle less than 180°, or even less than 90° with the other element (for example another edge formed in the casing or one wall of the cabinet). In practice, the more pointed the shape, the better the acoustic result.

The inlet of the port is then formed at least in part by the edge of the recess.

According to an advantageous embodiment, the initial width of the recess is equal to a width of at least one partition of the casing in which it is formed, the width of the partition corresponding to its dimension in a direction parallel to the width of the recess. In the case where the port has a cylindrical shape, the width then corresponds to the perimeter of the port. The inlet of the port is then completely defined by the recess.

A recess thus makes it possible to limit the phase shift induced between the loudspeaker and the port at the resonance frequencies $f_r$, which results in a smoothing of the frequency response instead of marked peaks as in the case of a standard port. Thus, the angular radiation has better stability as a function of the frequency, by suppressing the higher-order resonance frequencies.

Preferably, the depth p of the recess is equal to one quarter of the wavelength corresponding to the first higher-order resonance frequency $f_{r1}$ above the resonance frequency $f_2$.

The recess extends in length over at least a part of the casing, and preferably has a depth p less than the length L of the casing. In other words, the end of the recess and the outlet of the port are preferably separate.

The length L of the port as well as the depth p of the recess are defined as a function of the tuning frequency $f_c$ and the resonance frequencies $f_r$.

Advantageously, the recess has two edges at least one edge of which is defined by a straight line following a surface of the casing.

The other element is then formed by a second edge cut out in the casing.

In the case of a port with a circular cross-section, the port can be produced by folding or extrusion. If it is produced by folding, the straight cut-out of at least one edge of the recess is preferably produced before the folding.

In the case of a parallelepiped port, or in the general case where it has at least one flat face on which the recess is formed, it is immaterial whether the cut-out is made before or after the port is put in place, provided that the face is not deformed (in which case it is then preferably made beforehand).

A straight edge makes it possible to produce the recess very easily with a good result as regards the radiation.

Advantageously, the recess has two edges at least one edge of which is defined by a curve following a surface of the casing.

Similarly, if the casing of the port is deformed for installing the port in the cabinet it is preferable that the curve is defined and cut out beforehand.

The curve is preferably defined by a portion of a hyperbole.

A shape that is curved, even more advantageously according to an abovementioned hyperbole equation, makes it possible to improve the results obtained as regards the radiation measurements, i.e. on the directivity function. Thus a more constant radiation is obtained as a function of the frequency over the widest possible angular coverage, as well as a response in the more linear axis of the cabinet.

Preferably, the two edges of the recess are symmetrical with respect to a plane orthogonal to the casing. This symmetry facilitates the production of the port and its assembly in the cabinet, while improving the acoustic response.

For example, the recess has a width at its end much less than the initial width.

Preferably, the recess has a convex shape.

The convexity is assessed from the point of view of the recess, i.e. a width of the recess, defined by the distance between its two edges in a direction orthogonal to its depth p, is increasingly narrow according to a non-linear function, giving the recess an arched shape.

This shape makes it possible to have a recess that is wide at its starting point while having the most pointed shape possible.

For example, an edge of the recess defines at one end of the recess an angle less than 180°, or even less than 90°.

For example, two edges of the recess define between them an acute angle at the end of the recess.

For example, a width of the recess is increasingly narrow from a starting point towards one end according to a non-linear function, giving the recess an arched shape.

According to an advantageous embodiment, the inlet of the port has several recesses, each with one end, which are preferably symmetrical with respect to at least one plane orthogonal to the casing passing through their ends.

The depth of each of the recesses is then calculated for the different peaks each corresponding to a higher-order resonance frequency, which further improves the acoustic response.

Preferably, the inlet of the port has several identical recesses.

This facilitates the production steps without influencing the directivity.

According to a useful embodiment example, the cabinet has two recesses formed in a partition, which are mirror-symmetrical with respect to a median plane orthogonal to the partition.

According to another embodiment example, an internal volume of the port defined by the casing of the port advantageously comprises at least one wall dividing the internal volume into sub-volumes, making it possible to confer greater rigidity on the casing of the port.

For example, the casing of the port (3) is cylindrical.

According to an embodiment example, the inlet is defined by at least the edges of the recess and by an additional part.

The additional part is for example defined in a plane parallel to a plane comprising the outlet of the port.

According to an embodiment example, one of the edges of the recess is formed by one wall of the cabinet.

According to another embodiment example, the two edges of the recess are formed in a partition of the casing of the port.

Thus, a speaker cabinet is also proposed, comprising at least one loudspeaker and at least one port, the port being composed of a casing, formed by at least one partition, the casing having an inlet and an outlet and defining an internal volume of the port with the inlet situated in the cabinet and the outlet constituted by an opening formed in one wall of the cabinet, and the port comprising a recess extending into the partition.

Such a cabinet has all or some of the features presented previously.

A speaker cabinet is also proposed, comprising at least one loudspeaker and at least one port, the port being composed of a casing, formed by at least one partition, the casing having an inlet and an outlet and defining an internal volume of the port with the inlet situated in the cabinet and the outlet constituted by an opening formed in one wall of the cabinet, the port comprising a recess extending into the partition, the recess being formed by two straight edges extending from the inlet and joined at one end, the two edges of the recess defining an acute angle at the end.

Such a cabinet has all or some of the features presented previously.

A speaker cabinet is also proposed, comprising at least one loudspeaker and at least one port, the port being composed of a casing, formed by at least one partition, the casing having an inlet and an outlet and defining an internal volume of the port with the inlet situated in the cabinet and the outlet constituted by an opening formed in one wall of the cabinet, and the port comprising a recess extending into the partition, the recess being formed by two curved edges extending from the inlet and joined at one end, the two edges of the recess defining between them a width of the recess which is increasingly narrow according to a non-linear function, giving the recess an arched shape.

Such a cabinet has all or some of the features presented previously.

A speaker cabinet is also proposed, comprising at least one loudspeaker and at least one port, the port being composed of a casing, formed by at least one partition, the casing having an inlet and an outlet and defining an internal volume of the port with the inlet situated in the cabinet and the outlet constituted by an opening formed in one wall of the cabinet, the port comprising a recess extending into the partition, the recess being formed by two edges extending from the inlet and joined at one end in a pointed shape.

Such a cabinet has all or some of the features presented previously.

For example, one comprises two identical sub-cabinets each comprising two loudspeakers and at least one port as described previously, each sub-cabinet being a cabinet having all or some of the features described previously.

For example, the casing of the port of each sub-cabinet defines an internal volume of the port which comprises two walls dividing the internal volume into three sub-volumes.

The present invention will be better understood and its advantages will become more apparent on reading the following detailed description, given indicatively and non-limitatively with reference to the drawings referred to below:

Figure 1:
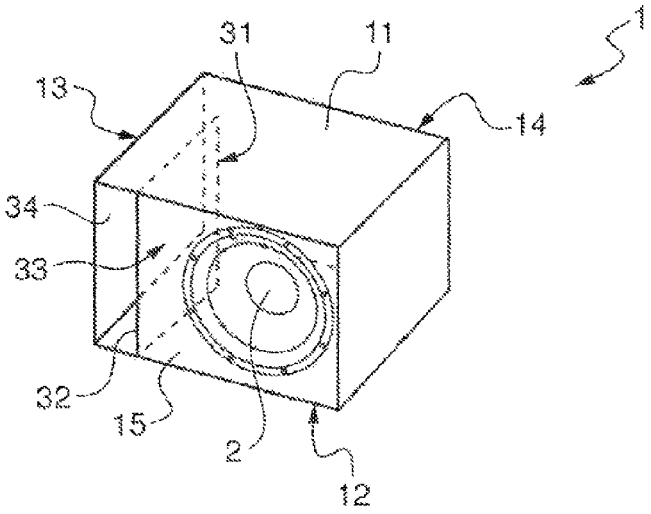
FIG. 1 shows an isometric view of a cabinet with a standard port.
Figure 2:
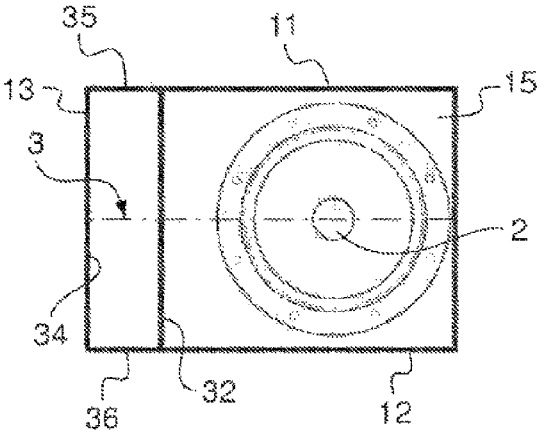
FIG. 2 represents a front view of the cabinet of FIG. 1.
Figure 3:
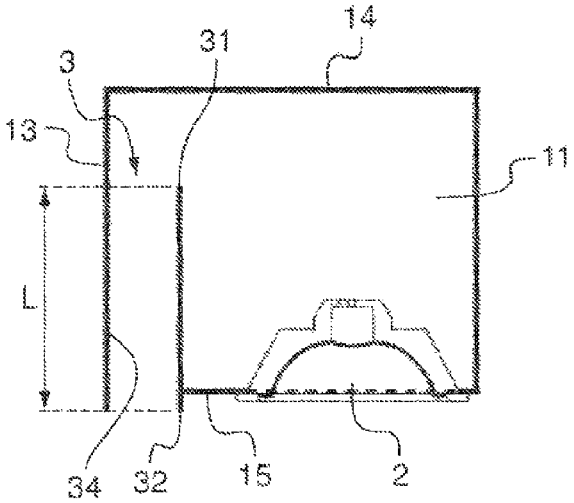
Figure 4:
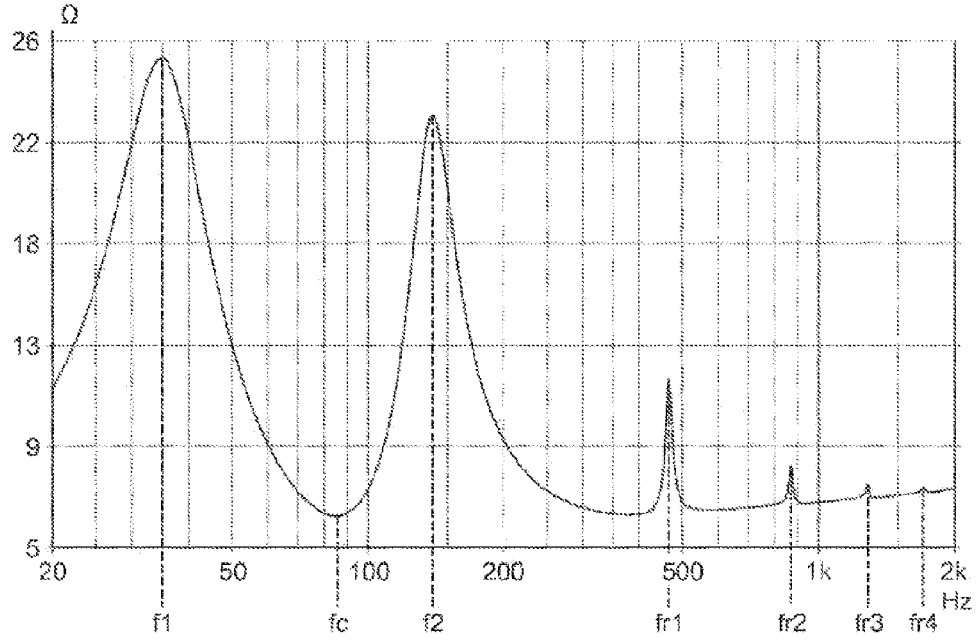
Figure 5:
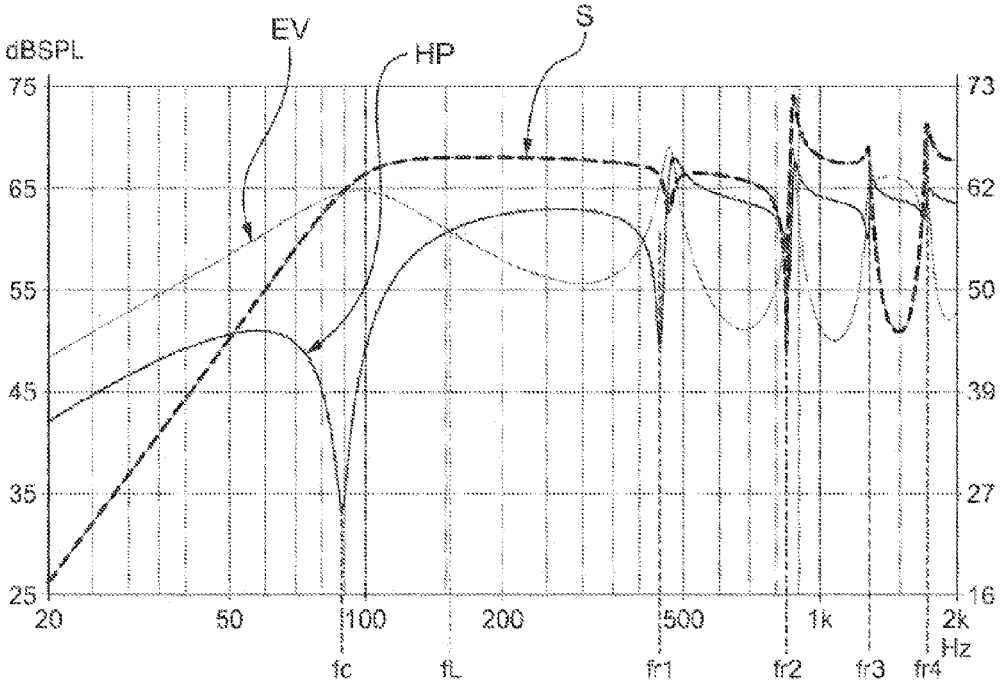
Figure 6A:
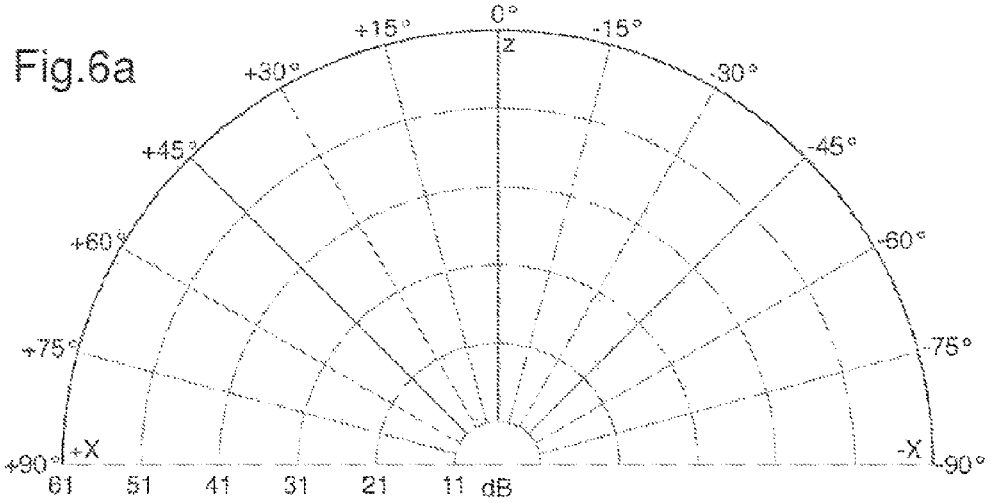
Figure 6B:
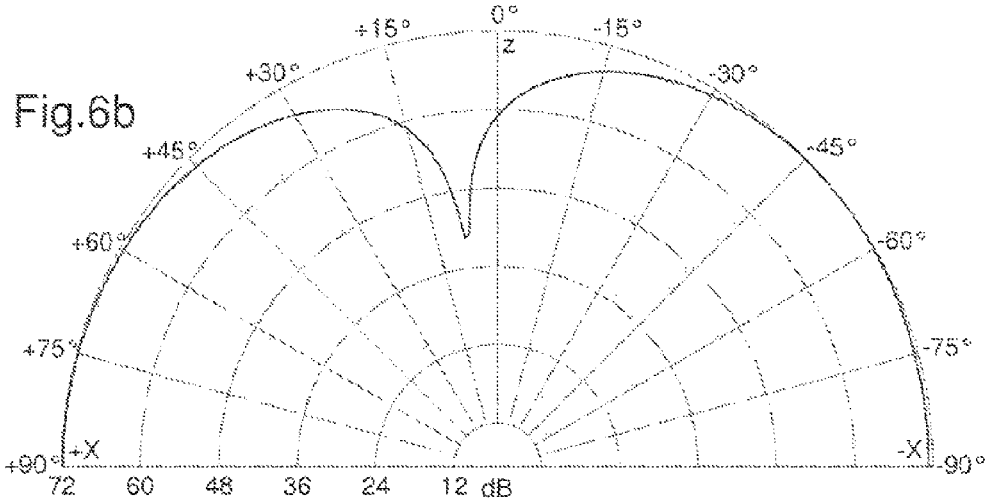
Figure 6C:
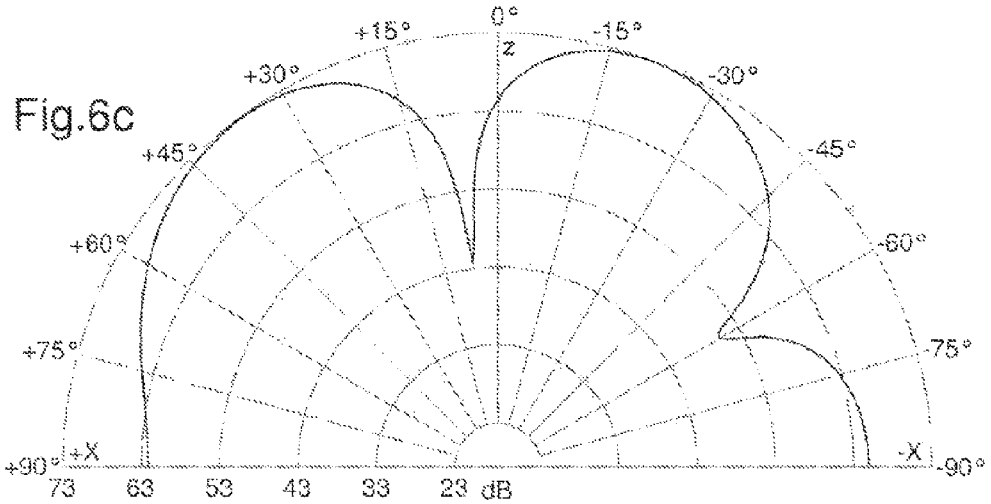
Figure 15:
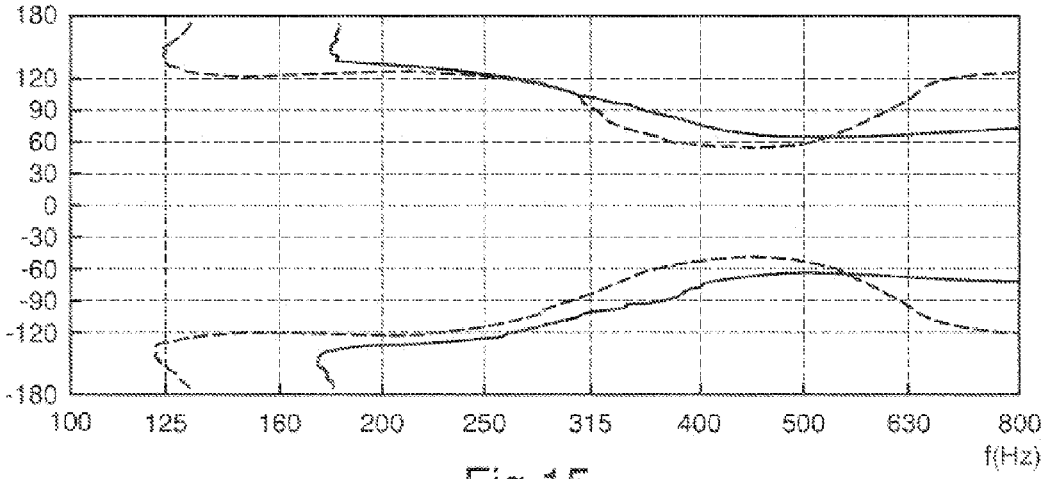
Figure 16:
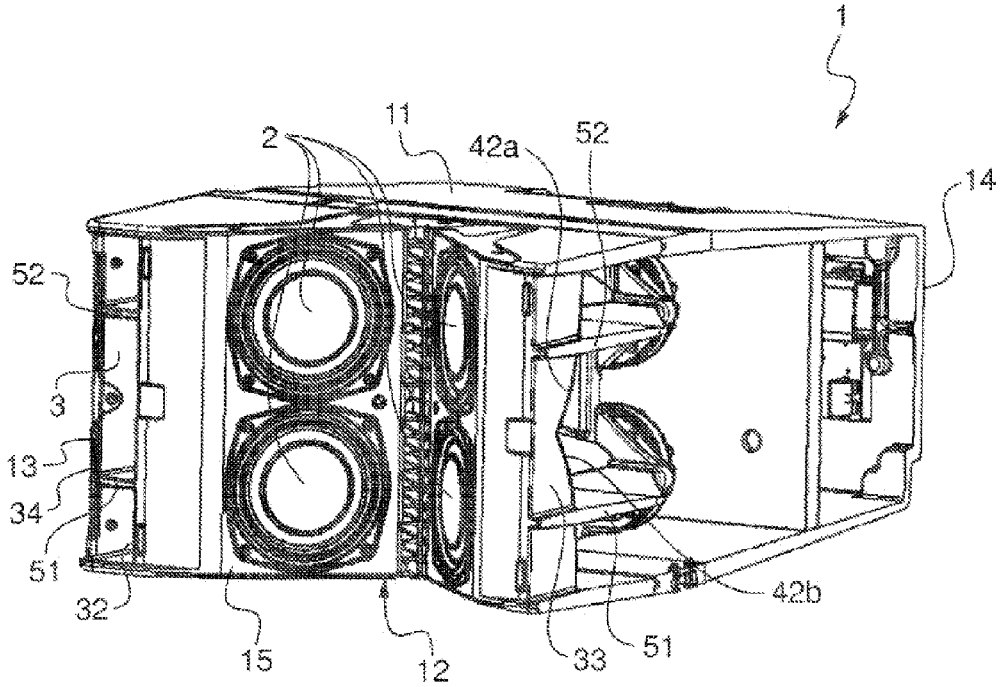

FIG. 3 presents a top view of the cabinet of FIG. 1;

FIG. 4 is a graph representing the electrical impedance of a loudspeaker in a conventional bass-reflex cabinet, i.e. with a standard port;

FIG. 5 represents the radiation of the port (EV) and the loudspeaker (HP), and the sum thereof (S) for a conventional bass-reflex cabinet;

FIGS. 6*a*, 6*b*, and 6*c* illustrate the directivity of a bass-reflex cabinet with a conventional port, at the tuning frequency $f_c$, and at the resonance frequencies $f_{r1}$ and $f_{r2}$ respectively;

FIG. 7 shows a bass-reflex cabinet with a port according to the invention according to a first embodiment example;

FIG. 8 shows a cross-section of the cabinet of FIG. 7;

FIG. 9 shows a bass-reflex cabinet with a port according to the invention according to a second embodiment example;

FIG. 10 represents a parallelepiped port according to the invention with a V-shaped recess, i.e. with two straight edges;

FIG. 11 represents a parallelepiped port according to the invention with a convex recess;

FIG. 12 represents a parallelepiped port according to the invention with two identical convex recesses that are symmetrical with respect to a median plane of the port;

FIG. 13 represents a cylindrical port with a circular cross-section according to the invention with a convex recess;

FIGS. 14*a* to 14*h* represent diagrams of directivity at 160 Hz, 200 Hz, 250 Hz, 315 Hz, 400 Hz, 500 Hz, 630 Hz and 800 Hz respectively, for a standard port (dotted lines) and a port with a recess according to the invention (solid line);

FIG. 15 represents the angular coverage at −6 dB (decibels) for a standard port (dotted lines) and a port according to the invention (solid line); and FIG. 16 shows an isometric view of an embodiment example of a cabinet according to the invention.

A conventional bass-reflex cabinet 1 generally has a parallelepiped shape as represented in particular in FIG. 1, but any kind of shape would be suitable.

By height of the cabinet 1, is here meant the dimension of the cabinet defined between a top face 11 and a bottom face 12. The cabinet 1 has a front face 15 on which a loudspeaker 2 and a port 3 are positioned. A rear face 14 is opposite the front face 15. Finally, the cabinet 1 has two side faces, including a backing 13.

The port 3 has an outlet 32 opening at the front face 15 of the cabinet 1. The outlet 32 is typically a hole, or a cut-out, formed in the front face 15 of the cabinet 1.

The port 3 comprises a casing defined by a first, internal, partition 33, a second partition 34 which is here constituted by the backing 13, a top partition 35 and a bottom partition 36. The top partition 35 is here formed by a part of the top face 11, and the bottom partition 36 is here formed by a part of the bottom face 12.

According to the present example, the outlet 32 has a rectangular shape and extends the entire height of the cabinet 1. It is itself defined by a front edge of the partitions 33, 34, 35, 36, delimiting the hole in the front face 15.

Finally, the port has an inlet 31 which is defined by the edge of the partition 33. The air then circulates in the port by passing between the partition 33 and the top 11, bottom 12 and rear 14 faces of the cabinet 1.

The partition 33 has a length L defining the length of the port 3.

In a conventional cabinet 1, the port is then standard, and in the present case the partition 33 is a rectangular panel, for example of wood; the edge 31 is parallel to the rear face 14.

According to another conventional embodiment (not shown), the port is cylindrical with a circular cross-section. The outlet of the port is then a circular hole formed in the front face of the cabinet and the casing is generally constituted by only a single partition which corresponds to the partition 33 described previously, inside the cabinet, an edge of which opposite the outlet, constitutes the inlet of the port. The edge of the inlet of a conventional port is then comprised within a plane, and the plane is generally parallel to the front face of the cabinet.

FIG. 4 represents the impedance curve in Ohm (Ω), measured at the loudspeaker terminals, for a conventional cabinet 1 as a function of the frequency in hertz (Hz).

As disclosed previously, the solving of the system of equations without approximation shows that there are, above the first two peaks, denoted $f_1$ and $f_2$, other resonance frequencies of the cabinet shown by other peaks at higher values (denoted $f_{r1}$, $f_{r2}$, $f_{r3}$, and $f_{r4}$).

The first two peaks (here approximately $f_1$=35 Hz and $f_2$=140 Hz respectively) are characteristic of a system with two degrees of freedom, the maximum vibration velocity of the port being obtained at the minimum situated between these two peaks, corresponding to the tuning frequency $f_c$ of the port, i.e. here approximately $f_c$=85 Hz.

The subsequent peaks (at approximately 460, 870, 1300 and 1650 Hz respectively) are very marked, and the amplitude of the radiation of the port may be comparable with that of the loudspeaker, creating pronounced accidents in the frequency response of the cabinet, which is visible in FIG. 5.

In fact, FIG. 5 illustrates the radiation of the port (EV curve), the radiation of the loudspeaker (HP curve), and the sum thereof (S curve), i.e. the radiation of the cabinet. The frequencies in hertz are shown along the x-axis, and the pressure level in dBSPL (decibel "Sound Pressure Level", i.e. the level of acoustic pressure) along the y-axis.

For frequencies less than the tuning frequency $f_c$, the loudspeaker and the port are out of phase. This results in the S curve being below the HP curve and/or the EV curve.

For frequencies greater than the tuning frequency $f_c$, the loudspeaker and the port are in phase, which has a constructive effect on the radiation.

However, there is a frequency $f_L$, referred to as the contribution limit frequency, above which the radiation of the port becomes less than that of the loudspeaker. Furthermore, as the resonance frequencies (here represented by $f_{r1}$, $f_{r2}$, $f_{r3}$ and $f_{r4}$) become closer together, interferences lead to a phase shift having an adverse effect on the radiation of the cabinet.

This adverse influence on the radiation is visible in FIGS. 6*b* and 6*c*, in comparison with FIG. 6*a*.

FIG. 6*a* shows the radiation in decibels (dB), according to the orientation with respect to the cabinet, at the limit frequency $f_c$. At this frequency, the radiation is stable irrespective of the orientation, and in the present case is equal to 61 dB.

At the frequency $f_{r1}$ (FIG. 6*b*), the resonance induces a drop in the radiation, in the present case from to 40 dB, to a position of approximately −8° with respect to the axis of the cabinet.

At the frequency $f_{r2}$ (FIG. 6*c*), the radiation becomes highly variable according to the orientation.

In order to overcome at least some of these drawbacks, the partition 33 of the port 3 has advantageously at least one recess at the inlet of the port.

Of course, if for the sake of simplicity of the drawings the embodiments shown comprise only one port, the present description is just as valid for a cabinet comprising two (or more) ports.

Conventionally, by partition 33, is here meant a partition forming at least in part the casing of the port 3 into which the recess according to the invention extends.

The length L of the port is then defined as the maximum distance between the inlet 31 and the outlet 32 each formed by at least a part of an edge of the partition 33 and along an axis orthogonal to the outlet 32.

The recess has a depth p representing the greatest distance between the inlet 31 and one end 40, along an axis parallel to that of the measurement of the length L.

Finally by width of the partition 33, is meant its dimension orthogonal to its length, and by initial width of the recess its dimension to its starting point along the width of the partition 33.

In FIGS. 7 to 12, the port is parallelepiped in shape. The recess or recesses are formed in the partition 33 at any time during the production of the cabinet since the partition 33 is not deformed. The aim is then to best simplify the production of the cabinet. It is however preferable to produce the recesses before the partition 33 is put into place in the cabinet 1, in particular when the port is an insert, for obvious reasons of protection and preservation of the cabinet.

In the embodiment example of FIG. 7, the inlet defined by the edge 31 has two lateral cut-outs defining two recesses.

Each of the recesses has an edge 41*a* and 41*b* so that the two recesses are symmetrical with respect to a median plane and orthogonal to the partition 33 (not shown).

A second edge of each of the recesses is here formed, respectively, by the top face 11 or the bottom face 12 of the cabinet 1.

The recesses thus have a curved edge 41*a* or 41*b* and a straight edge defined by a face 11 or 12 of the cabinet 1.

The edge 41*a* and the top face 11 thus define the first recess with an end 40*a*, and the edge 41*b* and the bottom face 12 thus define the second recess with an end 40*b*.

Furthermore, the curvature of the edge 41*a* makes it possible to define an acute angle with the top face 11 at the end 40*a*. The same applies between the edge 41*b* and the bottom face 12.

The two recesses being identical, they thus have the same depth p.

Furthermore, the curvature of the edges 41*a* and 41*b* is such that the edges 41*a* and 41*b* join each other. The inlet 31 is then completely defined by the edges 41*a* and 41*b* and no longer has a straight part parallel with the edge of the partition 33 defining a part of the outlet 32. The two recesses therefore have a width equal to half the width of the partition 33.

In the embodiment example of FIG. 9, the partition 33 has a central recess having two curved edges 42*a* and 42*b* that are symmetrical with respect to a median plane (not shown) and orthogonal to the partition 33.

The edges 42*a* and 42*b* define between them an acute angle at their end 40. Moreover, their curvature is such that the edge of inlet 31 is completely defined by the edges 42*a* and 42*b*. The width of the recess is then equal to the width of the partition 33.

FIGS. 10 to 13 represent ports according to the invention intended to be incorporated into a cabinet as described previously.

In the examples of the FIGS. 10 to 12, the port is parallelepiped shape and has an outlet 32 and an inlet 31, as well as a casing formed by flat partitions 33, 34, 35 and 36.

The inlet 31 of the port 3 has at least one recess in the casing of the port, formed here in the partition 33 inside the cabinet.

For the purposes of ease of production, such a port is preferably formed by incorporating only the partition 33 into the cabinet, the partitions 34, 35 and 36 being able to be advantageously formed, respectively, by a backing 13, a top face 11 and a bottom face 12 of the cabinet 1 with which they are then merged.

According to FIG. 10, the recess is formed by two straight edges 43*a* and 43*b*, also symmetrical with respect to a median plane (not shown) orthogonal to the partition 33. The edge of inlet 31 is here defined in part by the edges 43*a* and 43*b* as well as by an additional part 310, which is due to the fact that the recess defined by the edges 43*a* and 43*b* has a width less than the width of the partition 33.

With straight edges, it is therefore necessary for the recess to be less broad in order to retain as acute an angle as possible at the end, which makes it possible to obtain better results.

FIG. 11 shows a port similar to that of FIG. 9, but having a less broad opening. The edge 31 is then defined by the edges 44*a* and 44*b* as well as by an additional part 311.

The edges 44*a* and 44*b* give a convex shape to the recess which can then be defined by a hyperbolic portion, for example, for each of its edges.

FIG. 12 shows a port comprising two recesses comparable with that of FIG. 9, but the widths of which are both less than the width of the port, relatively shorter than the recess of FIG. 9, or of FIG. 11. The two recesses each have two curved edges 45*a* and 45*b* in the case of the first, 45*c* and 45*d* in the case of the second, which are symmetrical with respect to a plane orthogonal to the partition 33 and passing through the end 40 of the corresponding recess. These recesses are moreover symmetrical with respect to a median plane (not shown) and orthogonal to the partition 33. The inlet 31 is defined by the edges 45*a*, 45*b*, 45*c*, and 45*d*, as well as by an additional part 312 linking the starting point of the edge 45*b* to the starting point of the edge 45*c*. In the embodiment example of FIG. 12, the starting point of the edge 45*a* and that of the edge 45*d* are situated at an intersection with the flat partitions 35 and 36 respectively, of the port. However, the additional part 312 could be composed of several segments, not only one segment joining the starting point of the edge 45*b* to the starting point of the edge 45*c*, but also a segment joining the partition 35 to the starting point of the edge 45*a*, and/or a segment joining the starting point of the edge 45*d* to the partition 36. Or also, the additional part could comprise only one segment joining the partition 35 to the starting point of the edge 45*a*, and/or a segment joining the starting point of the edge 45*d* to the partition 36. According to yet another example, not only the starting point of the edge 45*a* and that of the edge 45*d* would be situated at an intersection with the flat partitions 35 and 36 respectively of the port, but the starting point of the edge 45*b* would be joined to the starting point of the edge 45*c* so that the edge of inlet 31 is now defined only by the edges 45*a*, 45*b*, 45*c*, and 45*d*.

FIG. 13 shows a tubular port. Such a port comprises a casing completely defined by the partition 33 one edge of which defines the outlet 32 and another edge defines the inlet 31. The inlet 31 is here formed by two edges 46*a* and 46*b* defining a recess, which are identical (i.e. symmetrical with respect to a median plane of the recess) as well as by an additional part 313. The width of the recess is here less than the perimeter of the inlet, the initial width of the recess being determined along the partition 33. This means that, for example, in a case where the initial width of the recess represents half of the circumference of the tubular port, the initial width is equivalent to the length of the arc of a circle along a fictitious edge of the port, i.e. a portion of the inlet edge which was present before being cut out in order to form the recess, and not a diameter or a chord length which would join the two roots of the recess.

Moreover, the additional part 313 is here defined in a plane parallel to a plane comprising the outlet 32. Such a port is advantageously produced by extrusion, for example of a polymeric material, but can also be formed by folding a sheet, for example a sheet of wood. In the case where the port is produced by folding or deformation of the partition which composes it, it is then advantageous to produce the cut-out beforehand.

These different possible configurations (number and dimensions of the recesses, and of the port or ports depend on the selection by a person skilled in the art confronted with the geometric and acoustic parameters of the cabinet.

Figure 14:
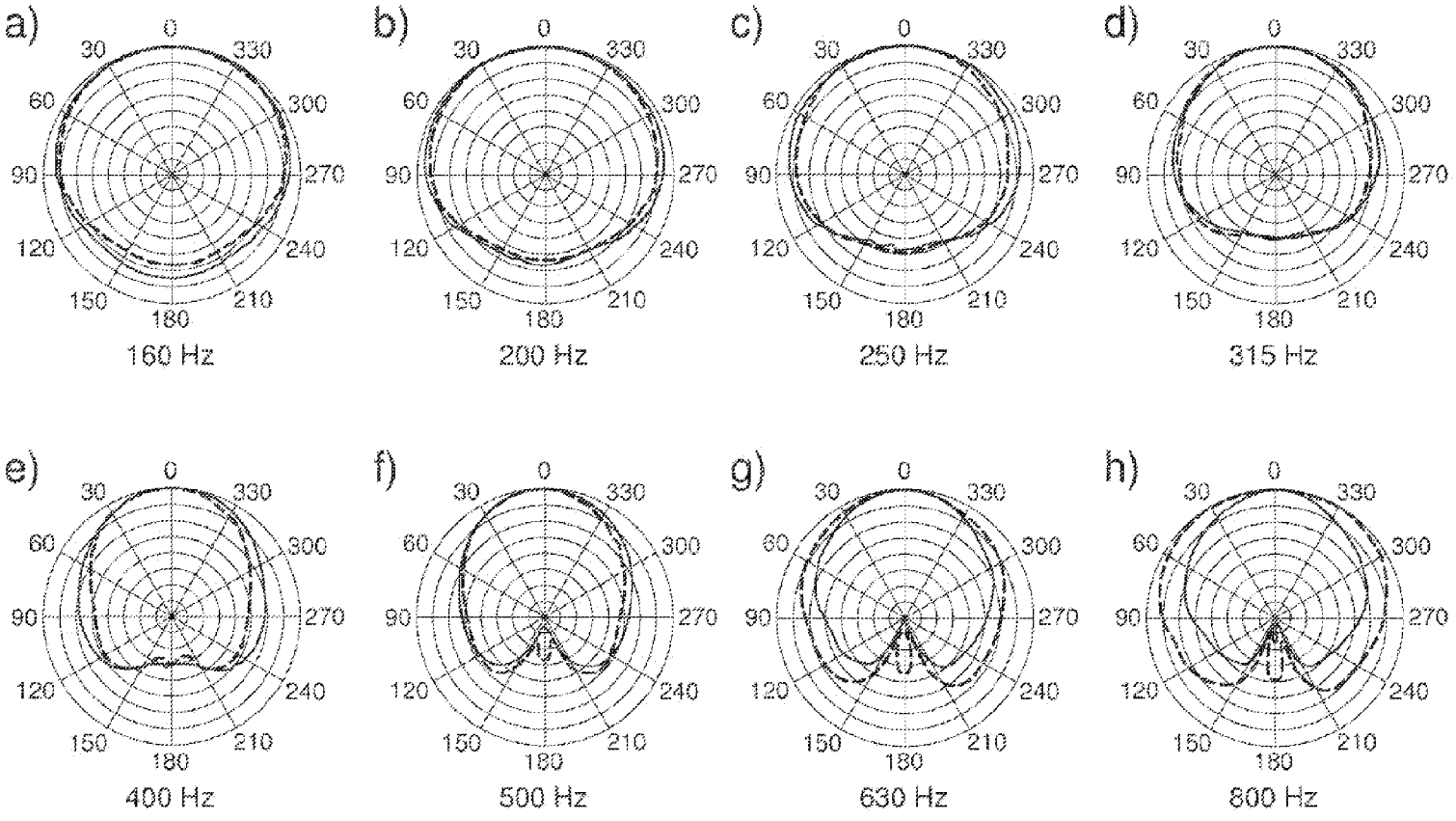

FIG. 14 shows the contribution of the recess to the directivity measurement results.

The dotted curve represents a standard port, and the solid curve represents a port with a recess according to the invention.

In these diagrams, a position at 0° represents a position in the axis of the cabinet, and a position at 180° represents a position behind the cabinet.

The presence of a recess makes it possible to stabilize the width of the directivity lobe, i.e. irrespective of the frequency, the coverage is more constant, which can also be seen in FIG. 15.

FIG. 15 represents the angular coverage at −6 dB for a conventional cabinet (dotted curve) and a cabinet with a port according to the invention (solid curve), as a function of the orientation with respect to the cabinet (a position at 0° representing the position in the axis of the cabinet whereas a position at 180° represents a position behind the cabinet).

In the absence of a recess, a clear narrowing of the angular coverage from 315 Hz to approximately 550 Hz is observed, then again a widening to approximately 800 Hz. In other words, the frequencies are not all communicated in the same proportions for a given orientation. For example, a person positioned at 45° with respect to the cabinet, i.e. at the side, will perceive far less the frequencies comprised between approximately 315 Hz and 620 Hz. The sound will therefore be significantly changed compared with a position facing the cabinet, at an equal distance.

If a recess is present, the graph shows that the angular coverage of the cabinet is progressively reduced to 400 Hz, in order to reach a stable value up to 800 Hz.

Finally FIG. 16 shows an example of a design of a cabinet 1 according to the invention. The cabinet 1 shown comprises two identical sub-cabinets (i.e. symmetrical with respect to a median plane of the cabinet 1).

Each sub-cabinet comprises two loudspeakers 2 and a port 3. A port 3 has a partition 33 with a recess formed by two edges 42*a* and 42*b*, i.e. the width of which is equal to that of the partition 33 as explained with reference to FIG. 9.

The port is here formed, apart from the partition 33, by a backing 34 of a sub-cabinet, and by a part of the top surface 11 and bottom surface 12. The casing thus formed defines an internal volume of the port which here comprises two walls 51 and 52, dividing the internal volume into three sub-volumes. Such walls 51 and 52 make it possible to reinforce the rigidity of the partition 33.

The invention claimed is:

1. A speaker cabinet (1) comprising:

at least one loudspeaker (2); and at least one port (3), the port (3) having an outlet (32) formed in one wall of the cabinet (1), an inlet (31) inside the cabinet (1), and a casing linking the inlet (31) and the outlet (32), wherein the port (3) includes at least one recess formed in the casing at the inlet (31) of the port (3), the at least one recess in the port being configured to limit peaks in the response of the port linked to the resonance frequencies ($f_r$), the recess having two edges, a depth p, and a width defined by a distance between the two edges in a direction orthogonal to the depth p, the width of the recess being variable according to the depth p, the width being maximum at the inlet (31) of the port (3) defining an initial width of the recess, wherein the casing of the at least one port (3) is located within the speaker cabinet at a location spaced apart from the at least one loudspeaker (2).

2. The cabinet (1) according to claim 1, wherein the recess has two edges, at least one edge of which is defined by a straight line following a surface of the casing.

3. The cabinet (1) according to claim 1, wherein the recess has two edges, at least one edge of which is defined by a curve following a surface of the casing.

4. The cabinet (1) according to claim 2, wherein the two edges of the recess are symmetrical with respect to a plane orthogonal to the surface of the casing.

5. The cabinet (1) according to claim 1, wherein the recess has a convex shape facing the outlet (32) of the port (3).

6. The cabinet (1) according to claim 1, wherein the casing, at the inlet (31) of the port (3), has plural of said recess, each said recess with one end (40), which are symmetrical with respect to at least one plane orthogonal to the casing passing through their end.

7. The cabinet (1) according to claim 1, wherein the casing, at the inlet (31) of the port (3), has plural identical recesses.

8. A speaker cabinet (1) comprising:

at least one loudspeaker (2); and at least one port (3), the port (3) having an outlet (32) formed in one wall of the cabinet (1), an inlet (31) inside the cabinet (1), and a casing linking the inlet (31) and the outlet (32), wherein the port (3) includes at least one recess formed in the casing at the inlet (31) of the port (3), the at least one recess in the port being configured to limit peaks in the response of the port linked to the resonance frequencies ($f_r$), the recess having two edges, a depth p, and a width defined by a distance between the two edges in a direction orthogonal to the depth p, the width of the recess being variable according to the depth p, the width being maximum at the inlet (31) of the port (3) defining an initial width of the recess, wherein the casing of the at least one port (3) is located within the speaker cabinet at a location spaced apart from the at least one loudspeaker (2), wherein the at least one recess is formed on a flat partition of the casing of the port.

9. The cabinet (1) according to claim 1, wherein the casing is comprised of at least one partition, and the initial width of the recess is equal to a width of the at least one partition (33) of the casing.

10. The cabinet (1) according to claim 1, wherein the recess begins with the initial width and ends at an end (40) with an end width which is much less than the initial width.

11. The cabinet (1) according to claim 1, wherein the cabinet has two recesses formed in a partition (33) of the casing, the two recesses being symmetrical with respect to a median plane and orthogonal to the partition (33).

12. The cabinet (1) according to claim 1, wherein a width of the recess is increasingly narrow from a starting point to one end (40) according to a non-linear function, giving the recess an arched shape.

13. The cabinet (1) according to claim 1, wherein an edge of the recess defines, at one end (40) of the recess, an angle less than 180°.

14. The cabinet (1) according to claim 1, wherein two edges of the recess define between them an acute angle at the end (40) of the recess.

15. The cabinet (1) according to claim 1, wherein an internal volume of the port (3) defined by the casing of the port (3) comprises at least one wall dividing the internal volume into sub-volumes, to confer greater rigidity on the casing of the port.

16. The cabinet (1) according to claim 1, wherein the casing of the port (3) is cylindrical.

17. The cabinet (1) according to claim 1, wherein the inlet (31) is defined by at least the edges of the recess and by an additional part (310).

18. The cabinet (1) according to claim 17, wherein the additional part (313) is defined in a plane parallel to a plane comprising the outlet (32) of the port (3).

19. The cabinet (1) according to claim 1, wherein one of the edges of the recess is formed by one wall of the cabinet.

20. The cabinet (1) according to claim 1, wherein two edges of the recess are formed in a partition (33) of the casing of the port (3).

21. A speaker cabinet (1) comprising at least one loudspeaker (2) and at least one port (3), the port (3) being composed of a casing, formed by at least one partition (33), the casing having an inlet (31) and an outlet (32) and defining an internal volume of the port (3) with the inlet (31) situated in the cabinet (1) and the outlet (32) constituted by an opening formed in one wall of the cabinet (1), and the port comprising a recess extending into the partition (33) from the inlet (31), wherein the at least one recess in the port is configured to limit peaks in the response of the port linked to the resonance frequencies ($f_r$), and wherein the casing of the at least one port (3) is located within the speaker cabinet at a location spaced apart from the at least one loudspeaker (2).

22. The cabinet (1) according to claim 21, wherein the recess is formed by two straight-line edges extending from the inlet (31) and joined at one end (40), the two edges of the recess defining an acute angle at the end (40).

23. A speaker cabinet (1) comprising at least one loudspeaker (2) and at least one port (3), the port (3) being composed of a casing, formed by at least one partition (33), the casing having an inlet (31) and an outlet (32) and defining an internal volume of the port (3) with the inlet (31) situated in the cabinet (1) and the outlet (32) constituted by an opening formed in one wall of the cabinet (1), and the port comprising a recess extending into the partition (33), the recess being formed by two curved edges extending from the inlet (31) and joined at one end (40), the two edges of the recess defining between them a width of the recess which is increasingly narrow according to a non-linear function, giving the recess an arched shape, wherein the at least one recess in the port is configured to limit peaks in the response of the port linked to the resonance frequencies ($f_r$), and wherein the casing of the at least one port (3) is located within the speaker cabinet at a location spaced apart from the at least one loudspeaker (2).

24. A speaker cabinet (1) comprising at least one loudspeaker (2) and at least one port (3), the port (3) being composed of a casing, formed by at least one partition (33), the casing having an inlet (31) and an outlet (32) and defining an internal volume of the port (3) with the inlet (31) situated in the cabinet (1) and the outlet (32) constituted by an opening formed in one wall of the cabinet (1), the port comprising a recess extending into the partition (33), the recess being formed by two edges extending from the inlet (31) and joined at one end (40) in a pointed shape, wherein the at least one recess in the port is configured to limit peaks in the response of the port linked to the resonance frequencies ($f_r$), and wherein the casing of the at least one port (3) is located within the speaker cabinet at a location spaced apart from the at least one loudspeaker (2).

25. The cabinet comprising two identical sub-cabinets according to claim 1.

26. The cabinet according to claim 25, wherein the casing of the port (3) of each sub-cabinet defines an internal volume of the port (3) which comprises two walls (51, 52) dividing the internal volume into three sub-volumes.

27. The cabinet (1) according to claim 1, wherein the cabinet has a resonance frequency $f_2$, and the depth p of the recess is equal to one quarter of the wavelength corresponding to the first higher-order resonance frequency $f_{r1}$ above the resonance frequency $f_2$.

* * * * *